US008800237B2

(12) United States Patent
Jardine

(10) Patent No.: US 8,800,237 B2
(45) Date of Patent: Aug. 12, 2014

(54) PRECAST WALL SECTION AND METHOD OF BUILDING A WALL

(75) Inventor: Mark Jardine, Ipswich Suffolk (GB)

(73) Assignee: Poundfield Products Limited, Ipswich (GB)

( * ) Notice: Subject to any disclaimer, the term of this patent is extended or adjusted under 35 U.S.C. 154(b) by 0 days.

(21) Appl. No.: 13/513,713

(22) PCT Filed: Dec. 3, 2010

(86) PCT No.: PCT/GB2010/052018

§ 371 (c)(1),
(2), (4) Date: Aug. 20, 2012

(87) PCT Pub. No.: WO2011/067605

PCT Pub. Date: Jun. 9, 2011

(65) Prior Publication Data

US 2013/0118103 A1 May 16, 2013

(30) Foreign Application Priority Data

Dec. 4, 2009 (GB) ..... 0921309.1

(51) Int. Cl.
*E04B 2/84* (2006.01)

(52) U.S. Cl.
USPC ..... 52/607; 52/745.1; 52/293.1

(58) Field of Classification Search
USPC ..... 52/426–428, 436, 565, 568, 600, 52/745.05, 745.09, 745.1, 293.426–428, 52/607, 745.11
See application file for complete search history.

(56) References Cited

U.S. PATENT DOCUMENTS

| | | | | | |
|---|---|---|---|---|---|
| 869,770 | A * | 10/1907 | Birnstock | 52/125.4 |
| 881,747 | A * | 3/1908 | Townsend | 256/19 |
| 1,072,760 | A * | 9/1913 | Miller | 52/314 |
| 2,882,715 | A * | 4/1959 | Zagray | 52/436 |
| 3,376,682 | A * | 4/1968 | Briscoe | 52/541 |
| 3,391,507 | A * | 7/1968 | Downing | 52/314 |
| 3,422,588 | A * | 1/1969 | Stewart, Jr. | 52/436 |
| 3,818,658 | A * | 6/1974 | Slaven | 52/169.1 |
| 4,167,840 | A * | 9/1979 | Ivany | 52/438 |
| 4,388,791 | A * | 6/1983 | Anderson | 52/719 |
| 4,461,130 | A | 7/1984 | Shubow | |
| 4,532,745 | A | 8/1985 | Kinard | |
| 5,596,855 | A * | 1/1997 | Batch | 52/309.11 |
| 6,705,057 | B2 * | 3/2004 | Smyer, III | 52/606 |
| 7,143,554 | B2 * | 12/2006 | Sachs et al. | 52/251 |

(Continued)

FOREIGN PATENT DOCUMENTS

| | | |
|---|---|---|
| EP | 1 983 113 | 10/2008 |
| FR | 2 869 926 | 11/2005 |

(Continued)

*Primary Examiner* — Brian Glessner
*Assistant Examiner* — Adam Barlow
(74) *Attorney, Agent, or Firm* — Burr & Brown, PLLC

(57) ABSTRACT

The invention relates to a freestanding wall section and a method of constructing a wall. The invention provides a wall section for use in building a wall comprising: a wall portion having a front face portion and a rear face portion; a connecting portion connecting said front face portion to said rear face portion and defining a cavity therebetween; in which the connecting portion has an aperture for receiving concrete mix and which in use allows the concrete mix to fill said cavity. The invention also provides a method of building a wall using such wall sections.

14 Claims, 4 Drawing Sheets

(56) References Cited

U.S. PATENT DOCUMENTS

| | | | |
|---|---|---|---|
| 2002/0059761 | A1 | 5/2002 | Budge |
| 2004/0244321 | A1 | 12/2004 | Dincel |
| 2005/0120659 | A1 | 6/2005 | Nickerson |
| 2008/0245013 | A1 | 10/2008 | Carlisle |
| 2009/0188186 | A1 | 7/2009 | Ebanks |

FOREIGN PATENT DOCUMENTS

| | | |
|---|---|---|
| FR | 2 897 084 | 8/2007 |
| WO | 86/05225 | 9/1986 |
| WO | 03/031740 | 4/2003 |

* cited by examiner

PRECAST WALL SECTION AND METHOD OF BUILDING A WALL

BACKGROUND a. Field of the Invention

This invention relates to a precast wall section and a method of constructing a wall.

b. Related Art

Concrete wall sections are well known and are used for a variety of purposes for example storing bulk products in a defined area, creating temporary wall structures while building work is being carried out for example as well as for creating more permanent wall sections. Wall created from such sections have the advantage that they are precast off site and delivered to the required location where the walls simply built by placing the sections where required and bolting them together, if desired, once placed.

A problem with known concrete wall sections and methods of building a wall from such structures is that if it is desired to create a wall for example running beside a newly built road where it is required to retain large quantities of soil, for example then the bulk and weight of the concrete wall sections required to withstand such required load is not very practical. It is a known problem that if a section is subject to an impact, for example if a section is hit by a fork lift truck during loading of bulk product, then and individual section can fail because the force of the impact is not spread through to other concrete wall sections.

A more robust structure may be created by casting concrete walls cast in situ. When creating such a wall, formwork known in the trade as 'shuttering' is built to hold the concrete in place whilst it hardens sufficiently. Such a formwork structure is usually made from huge steel plates bolted together and braced against the ground in order to withstand the pressures involved in retaining large amounts of concrete during hardening.

Before the concrete is poured into the formwork/shuttering any reinforcing structure, usually formed from steel bars, are inserted and tied together.

The cost of the shuttering system can cost more than ten times the cost of the materials required for the wall itself and furthermore, if walls are required which are three of four meters high then the health and safety precautions which need to be taken can be costly.

Therefore it is desirable to create a concrete wall section and a method of building a concrete wall with the low cost and convenience of using precast wall sections but with the strength and durability of a wall built in situ using shuttering.

SUMMARY OF THE INVENTION

The invention provides concrete wall sections for use is building a wall and a method of building a wall therefrom. The invention is used to create concrete wall which have a better finish than walls formed in situ and which are cheaper and quicker to erect than walls formed in situ, but which don't' suffer from the disadvantages associated with wall built using conventional concrete wall sections.

According to the invention there is provided a wall section for use in building a wall comprising: a wall portion having a front face portion and a rear face portion; a connecting portion connecting said front face portion to said rear face portion and defining a cavity therebetween; in which the connecting portion has an aperture for receiving concrete mix and which in use allows the concrete mix to fill said cavity.

In a preferred embodiment the wall section comprises a plurality of connecting portions defining a plurality of cavities between the front face portion and the rear face portion and in which each connecting portion has an aperture allowing received concrete mix to flow between and to fill the plurality of cavities.

Advantageously, one or more connecting portions further comprise a recess at the end of each connecting portion arranged to align with a recess in a corresponding connecting portion and allowing concrete to fill a further cavity thus created when two or more wall sections are aligned with one another.

Preferably the wall section further comprises a foot portion connecting the front and rear face portions at the base of the wall section.

In a similar way to the connecting portions, the foot portion further comprise a recess at the end of said foot portion arranged to align with a recess in a corresponding foot portion and allowing concrete to fill a further cavity thus created when two or more wall sections are aligned with one another.

In a preferred embodiment each of the front and rear face wall portions have a recess on their inner face for receiving reinforcing rods and the well section may further comprise one or more reinforcing rods connected to a recess in the front wall portion and connected to a recess in the real wall portion.

Preferably the reinforcing rod comprises two rod portions connected together and pulling the front face portion and the rear face portion together.

According to another aspect of the invention there is provided a method of building a wall using a plurality of wall sections comprising a wall portion having a front face portion and a rear face portion; a connecting portion connecting said front face portion and said rear face portion and defining a cavity therebetween; in which the connecting portion has an aperture for receiving concrete mix the method comprising the steps of: placing a plurality of wall sections adjacent one another such that the plurality of wall portions are aligned; pouring concrete mix though an aperture in a connecting portion in one or more of said plurality of wall sections until the cavity in each wall section is substantially filled.

Preferably the wall section further comprises a plurality of connecting portions defining a plurality of cavities between the front face portion and the rear face portion and in which each connecting portion has an aperture and in which the pouring step is continued until all of the cavities in all of the wall sections are substantially filled.

In a preferred embodiment one or more connecting portions further comprise a recess at the end of each connecting portion arranged to align with a recess in a corresponding connecting portion and in which the method further comprises filling the further cavity thus created when two or more wall sections are aligned with one another.

In order to reinforce the resulting wall, each of the front and rear face wall portions have a recess on their inner face and a plurality of short reinforcing rods connected between corresponding recesses and in which the method further comprises, after placing a plurality of wall sections adjacent one another and prior to pouring the concrete mix, inserting long reinforcing rods through a plurality of cavities resting on said short reinforcing rods.

Preferably the long reinforcing rods are staggered with respect to each other such that a long rod spans different wall sections to those spanned by another long rod.

DETAILED DESCRIPTION

In the following description like features of the invention are referenced by like numerals when shown in different embodiments.

Figure 1:
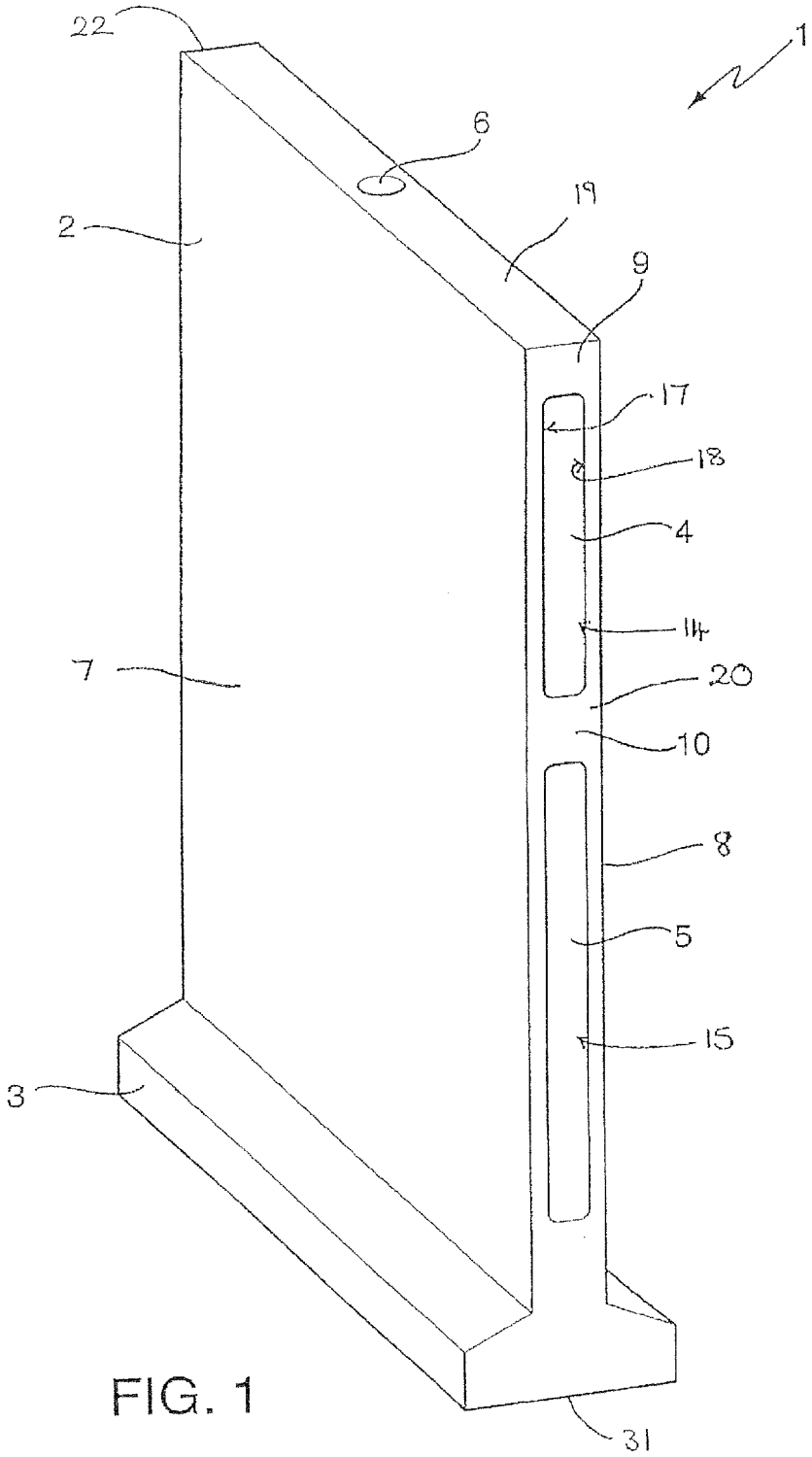
FIG. 1 is a perspective view of a concrete wall section in accordance with one embodiment of the invention.

FIG. 1 illustrates a free-standing wall section 1 according to the present invention. The wall section 1 comprises a wall portion 2 having a rectangular front face portion 7 and a rectangular rear face portion 8. The front and rear face portions are spaced apart from each other and lie in substantially parallel planes. In a preferred embodiment, the wall section 1 also comprises a foot portion 3. The foot portion 3 forms a substantially solid base of the wall section 1. The foot portion 3 extends beyond the front and rear faces 7, 8 of the wall portion 2 so that the thickness of the wall section 1 at the base 31 is greater than the thickness of the wall portion 2. In other embodiments, the foot portion 3 may not extend beyond the front and rear faces 7, 8 and may comprise a solid member joining said front and rear faces 7, 8 and forming a lower edge of the wall section 1.

Connecting portions 9 and 10 connect the front face portion 7 to the rear face portion 8. In particular an upper connecting portion 9 spans the gap between the front face portion 7 and rear face portion 8 of the wall portion at a top of the wall portion 2. In this way, the upper connecting portion 9 joins the front and rear face portions 7, 8 and forms a top edge or top surface 19 of the wall section 1.

A second connecting portion 10 also spans the gap between the front and rear face portions 7, 8. In this embodiment, the second connecting portion 10 is located approximately halfway up the height of the wall portion 2. This second connecting portion 10 extends across the full width of the wall portion 2.

In this way two substantially rectangular cavities 4, 5 are formed within the wall portion 2. A first cavity 4 is bounded on four sides by internal surfaces 17, 18 of the front and rear face portions 7, 8 respectively and the upper and lower connecting portions 9, 10. Similarly a second cavity 5 is bounded on four sides by internal surfaces 17, 18 of the front and rear face portions 7, 8 the lower connecting portion 10 and the foot portion 3. The ends 14, 15 of each of the cavities 4, 5 are open such that the cavities 4, 5 extend for the full width of the wall portion 2 and create respective openings 14, 15 in each of the end faces 20, 22 of the wall portion 2.

Figure 2:
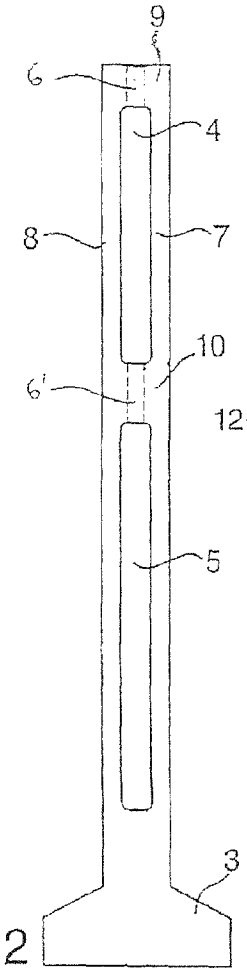
FIG. 2 is a side view of a concrete wall section in accordance with another embodiment of the invention.

The two cavities 4 and 5 may be accessed through an aperture 6, the function of which will be described in due course. In particular, an aperture 6, 6' is present in each of the connecting portions 9, 10. In this embodiment, the apertures 6, 6' comprise a cylindrical bore extending substantially vertically through each of the connecting portions 9, 10, as shown in FIG. 2. A single aperture 6, 6' is present in each connecting portion 9, 10 and each of the apertures is located substantially centrally with respect to the front and rear faces 7, 8 and the end faces 20, 22 of the wall portion 2. In other embodiments the apertures 6, 6' may not be located in the centre of the wall portion 2, however, preferably the apertures 6, 6' are vertically aligned with each other when the well section is standing in an upright position.

The aperture 6' is the lower connecting portion 10 provides a path between the upper and lower cavities 4, 5, the importance of which will be described later.

The wall section 1 is precast from concrete using a mould in a manner which is well known in the art. In some cases it may be advantageous to precast the wall section 1 having solid connecting portions 9, 10 and then drill through these connecting portions to form the apertures 6, 6'.

In a method of building a free-standing wall a number of wall sections 1 are placed side by side such that their respective end faces 20, 22 are in contact and their respective front and rear face portions 7, 8 are aligned. Once all of the required wall sections 1 have been placed in their correct positions concrete is poured through each of the apertures 6 in the top connecting portions 9 of one or more sections 1. The concrete flows through the aperture 6 into the upper cavity 4 and is then able to flow through the aperture 6' in the second connecting portion 10 and into the lower cavity 5.

Because the ends 14, 15 of the cavities 4, 5 are open, concrete is able to flow through into an aligned cavity 4, 5 in an adjacent wail section 1.

Once the concrete has set the result is a very strong wall similar to a wall cast in situ due to the fact that all the adjacent wall sections 1 are connected by set concrete in adjacent cavities 4, 5

In a preferred method of building a free-standing wall, the foot portion 3 is located in a trench dug prior to placing the wall sections in aligned positions to form the wall. Once the wall sections are in position, further concrete is poured into the trench and around the foot portion 3 in order to make the wall more secure and to compensate for any irregularities or unevenness either in the base 31 of the precast wall section units or in the surface upon which they are placed.

Figure 4:
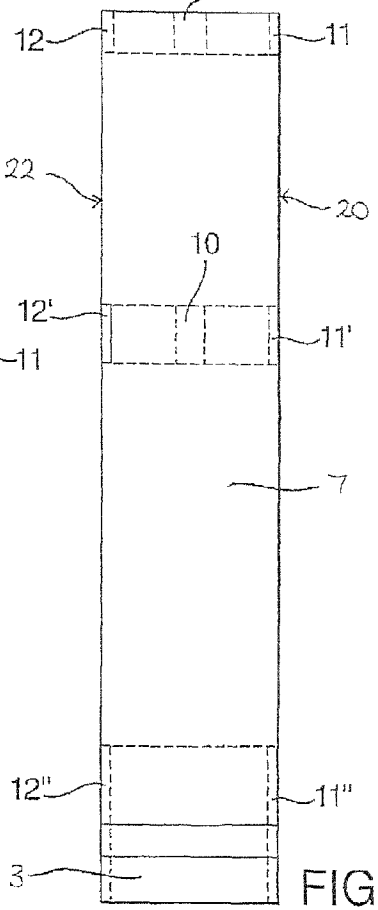
FIG. 4 is a front view of a concrete wall section shown in FIG. 2.
Figure 3:
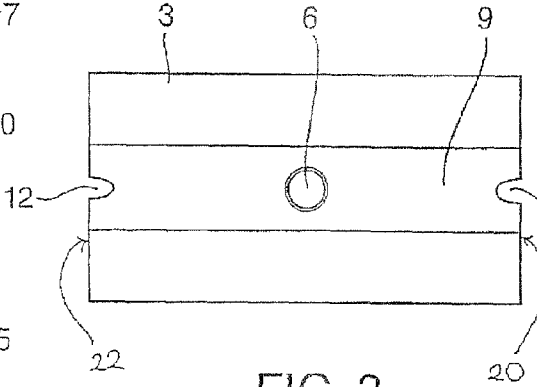
FIG. 3 is a top view of the concrete wall section shown in FIG. 2.

Referring now to FIGS. 3 and 4, which show respectively a top view and a front view of the wall section of FIG. 2, in a preferred embodiment of the invention each connecting portion 9, 10 and the foot portion 3 has a recess 11,12,11',12', 11",12". The recesses are in the form of a semi-cylindrical channel in each of the end faces 20, 22 of the wall section 1. The channels extend vertically through each of the connecting portions 9, 10 and the foot portion 3.

When wall sections 1 are positioned side by side so as to form a free-standing wall, the end faces 20, 22 are in contact and these recesses 11,12,11',12',11",12" align to form a further vertical cylindrical cavity. When concrete is poured in to create the connected wall, the cylindrical cavities thus formed are also filled with concrete which acts to create an even stronger completed wall by bonding together adjacent end faces 20, 22

Figure 5:
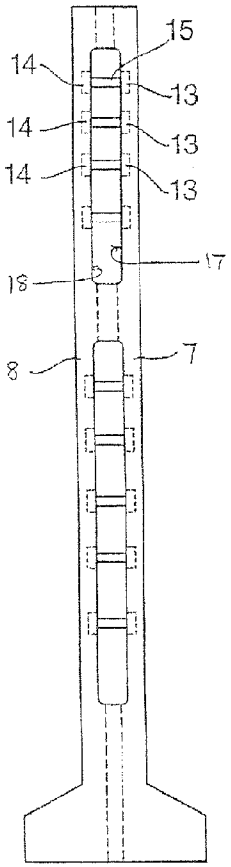
FIG. 5 is a side view of a wall section in accordance with another embodiment of the invention.

FIG. 5 shows a side view of another preferred embodiment of the invention in which each front face portion 7 and rear face portion 8 are provided with further recesses 13, 14 which are used to receive reinforcing rods 15.

These reinforcing rods 15 serve both to reinforce the additional concrete received within the cavities 4, 5 and also to brace the front face portion 7 and the rear face portion 8 together.

The recesses 13, 14 are formed during moulding of the wall section 1 by attaching a number of threaded pipes to the interior of the mould using a magnet. After the concrete has set in the mould the pipes are removed leaving a plurality of threaded recesses 13, 14 in the internal surfaces 17, 18 of each of the front and rear face portions 7, 8, into which a reinforcing rod 15 may be inserted. In particular the threaded pipes create correspondingly aligned threaded recesses 13, 14 in the front and rear face portions 7, 8. A first part of a reinforcing rod is inserted into a recess 13 in an internal surface 17 of the front wall portion 7 and a second part of a reinforcing rod is inserted into a recess 14 in an internal surface 18 of the rear wall portion 8. The two aligned rod parts are then clamped together and tightened so that the front face portion 7 and rear face portion 8 are held together.

Figure 6:
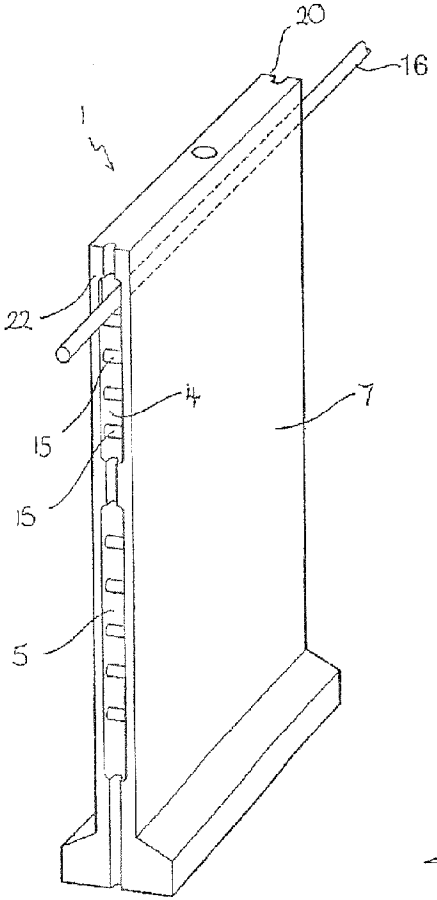
FIG. 6 is a sketch showing a wall section as shown in FIG. 5 with further reinforcing rods inserted through a cavity.

As well as reinforcing the resulting wall and holding the front and rear face portions 7, 8 together, the use of the short reinforcing rods has another advantage. Once a number of wall sections 1 have been aligned to form a free-standing wall, longer reinforcing rods 16 may be introduced into the cavities 4, 5 of the wall portion 2 substantially perpendicularly to the short reinforcing rods 15. The longer reinforcing rods 16 rest on the shorter reinforcing rods 15 and span the full width of the wall section 1 and thus serve as further reinforcement for the resulting wall. A single long reinforcing rod is shown schematically in FIG. 6. Preferably the longer reinforcing rods 16 are longer than the width of the wall section 1 so that end portions of the reinforcing rods 16 protrude from the end faces 20, 22. It will be appreciated that a number of these long reinforcing rods are inserted prior to filling the cavities with concrete. It is an advantage if the longer reinforcing rods 16 are staggered with respect to one another throughout the free-standing wall so that each long rod 16 spans different wall sections 1.

Figure 7:
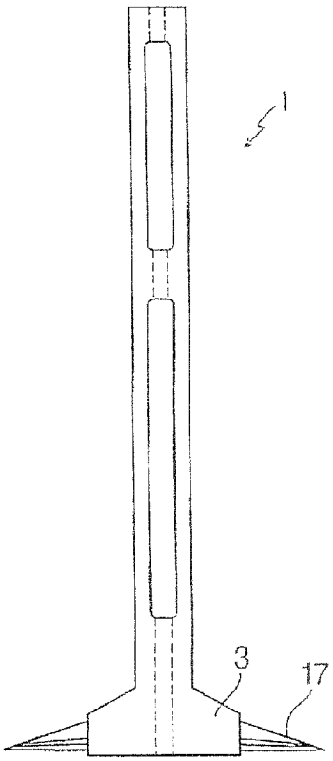
FIG. 7 show reinforcing extending from the foot of a wall section.

FIG. 7 illustrates a further embodiment of the invention which includes optional reinforcement 17 that extends from the foot portion 3 of the wall section 1. These reinforcing members 17 are designed to extend from the foot portion 3 of the precast wall section 1. In this example the reinforcing members 17 extend perpendicularly from the wall section. This additional reinforcing 17 allows the wall section to be more firmly secured within a trench as described above.

Figure 10:
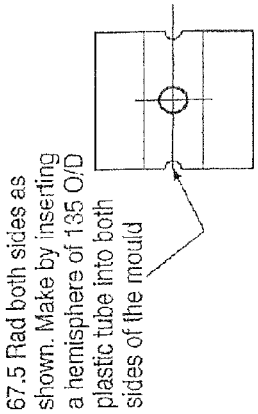
FIG. 10 is a top view of the preferred embodiment of FIG. 8.
Figure 9:
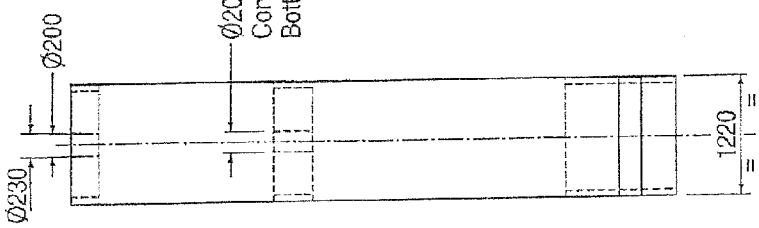
FIG. 9 is a front view of the preferred embodiment of FIG. 8.
Figure 8:
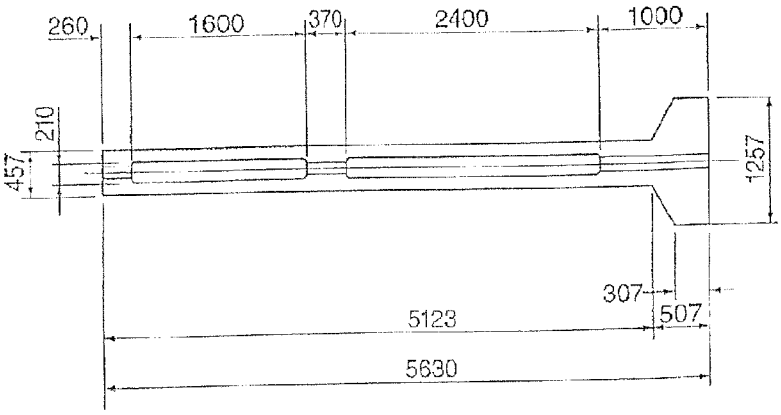
FIG. 8 is a side view of a preferred embodiment of the invention showing dimensions in mm.

FIG. 8 to 10 show the dimensions of a preferred embodiment of the present invention.

Whilst the term concrete is used throughout is will be clear that the present invention extends to wall sections which may be cast from any material having properties similar to those of concrete, and which may be cast in a similar manner.

The invention claimed is:

1. A free standing wall section for use in building a wall comprising:

a pre-cast concrete wall portion having a front face portion and a rear face portion, and end faces, the distance between the end faces defining a width of the wall portion;

an upper connecting portion connecting said front face portion to said rear face portion at a top of said wall portion and defining a top edge or top surface of said wall section;

a foot portion connecting the front and rear face portions at the base of the wall section and forming a solid base of the wall section, the foot portion extending beyond the front and rear faces of the wall portion, such that the thickness of the wall section at the base is greater than the thickness of the wall portion;

a lower connecting portion connecting said front face portion to said rear face portion across the full width of the wall portion;

a first cavity bounded by the front and rear face portions, the upper connecting portion and the lower connecting portion;

a second cavity bounded by the front and rear face portions, the lower connecting portion and the foot portion;

a first aperture in the upper connecting portion providing access to the first cavity for receiving concrete mix;

a second aperture in the lower connecting portion providing a path between the first and second cavities for receiving concrete mix; and a recess on an inner face of each of the front and rear face portions, and a reinforcing rod connected to the recess in the front face portion and connected to the recess in the rear face portion.

2. A wall section according to claim 1 further comprising a plurality of connecting portions defining a plurality of cavities between the front face portion and the rear face portion, and in which each connecting portion has an aperture allowing received concrete mix to flow between and to fill the plurality of cavities.

3. A wall section according to claim 1 in which one or more of the connecting portions further comprises a recess in each of the end faces of the wall portion, each recess being arranged to align with a corresponding recess in an adjacent connecting portion when, in use, two or more wall sections are positioned end-to-end, the aligned recesses creating a further cavity for receiving concrete mix.

4. A wall section according to claim 1, in which the foot portion further comprises a recess at each end of said foot portion, each recess being arranged to align with a corresponding recess in an adjacent foot portion when, in use, two or more wall sections are positioned end-to-end, the aligned recesses creating a further cavity for receiving concrete mix.

5. A wall section according to claim 1 in which the reinforcing rod comprises two rod portions connected together and pulling the front face portion and the rear face portion together.

6. A wall section according to claim 2, in which the foot portion further comprises a recess at each end of said foot portion, each recess being arranged to align with a corresponding recess in an adjacent foot portion when, in use, two or more wall sections are positioned end-to-end, the aligned recesses creating a further cavity for receiving concrete mix.

7. A wall section according to claim 2 in which one or more of the connecting portions further comprises a recess in each of the end faces of the wall portion, each recess being arranged to align with a corresponding recess in an adjacent connecting portion when, in use, two or more wall sections are positioned end-to-end, the aligned recesses creating a further cavity for receiving concrete mix.

8. A method of building a wall using a plurality of free-standing wall sections comprising:

a pre-cast concrete wall portion having a front face portion and a rear face portion, and end faces, the distance between the end faces defining a width of the wall portion;

an upper connecting portion connecting said front face portion to said rear face portion at a top of said wall portion and defining a top edge or top surface of said wall section;

a foot portion connecting the front and rear face portions at the base of the wall section and forming a solid base of the wall section, the foot portion extending beyond the front and rear faces of the wall portion, such that the thickness of the wall section at the base is greater than the thickness of the wall portion;

a lower connecting portion connecting said front face portion to said rear face portion across the full width of the wall portion;

a first cavity bounded by the front and rear face portions, the upper connecting portion and the lower connecting portion;

a second cavity bounded by the front and rear face portions, the lower connecting portion and the foot portion;

a first aperture in the upper connecting portion providing access to the first cavity for receiving concrete mix;

a second aperture in the lower connecting portion providing a path between the first and second cavities for receiving concrete mix; and a recess on an inner face of each of the front and rear face portions, and a plurality of short reinforcing rods connected between corresponding recesses;

the method comprising the steps of:

placing a plurality of wall sections adjacent one another end to end such that the plurality of wall portions are aligned; and pouring concrete mix through the first aperture in an upper connecting portion in one or more of said plurality of wall sections until the cavities in each wall section are substantially filled.

9. A method according to claim 8, in which the wall section further comprises:

a plurality of connecting portions defining a plurality of cavities between the front face portion and the rear face portion and in which each connecting portion has an aperture and in which the pouring step is continued until all of the cavities in all of the wall sections are substantially filled.

10. A method according to claim 8, in which one or more of the connecting portions further comprises a recess in each of the end faces of the wall portion, each recess being arranged to align with a corresponding recess in an adjacent connecting portion to create a further cavity, and in which the method further comprises filling the further cavity thus created with concrete mix.

11. A method according to claim 8, in which the method further comprises, after placing a plurality of wall sections adjacent one another and prior to pouring the concrete mix, inserting long reinforcing rods through a plurality of cavities, the long reinforcing rods resting on said short reinforcing rods.

12. A method according to claim 11 in which said long reinforcing rods are staggered with respect to each other such that a long rod spans different wall sections to those spanned by another long rod.

13. A method according to claim 9, in which one or more of the connecting portions further comprises a recess in each of the end faces of the wall portion, each recess being arranged to align with a corresponding recess in an adjacent connecting portion to create a further cavity, and in which the method further comprises filling the further cavity thus created with concrete mix.

14. A method according to claim 9, in which the method further comprises, after placing a plurality of wall sections adjacent one another and prior to pouring the concrete mix, inserting long reinforcing rods through a plurality of cavities, the long reinforcing rods resting on said short reinforcing rods.

* * * * *